US006096195A

United States Patent [19]

Streicher et al.

[11] Patent Number: 6,096,195

[45] Date of Patent: Aug. 1, 2000

[54] PROCESS AND UNIT FOR HYDROTREATING A PETROLEUM FEEDSTOCK THAT COMPRISES THE CRACKING OF AMMONIA AND THE RECYCLING OF HYDROGEN IN THE UNIT

[75] Inventors: Christian Streicher, Rueil Malmaison; Fabrice Lecomte, Vincennes; Christian Busson, Charbonniere, all of France

[73] Assignee: Institut Francais du Petrole, Rueil Malmaison Cedex, France

[21] Appl. No.: 09/138,547

[22] Filed: Aug. 24, 1998

[30] Foreign Application Priority Data

Aug. 25, 1997 [FR] France ..... 97 10679

[51] Int. Cl.[7] ..... C10G 45/02

[52] U.S. Cl. ..... 208/254 R; 208/212; 208/209; 423/351; 423/658.2; 422/188; 422/146; 422/144; 422/148; 422/198

[58] Field of Search ..... 208/209, 212, 208/254 H; 423/351, 658.2; 422/188, 146, 144, 148, 198

[56] References Cited

U.S. PATENT DOCUMENTS

| | | | |
|---|---|---|---|
| 3,365,374 | 1/1968 | Short et al. | 203/42 |
| 3,627,470 | 12/1971 | Hamblin | 23/193 |
| 3,752,252 | 8/1973 | Maier | 208/209 |
| 4,272,357 | 6/1981 | Rollmann | 208/89 |
| 4,548,618 | 10/1985 | Linde et al. | 55/16 |
| 4,629,553 | 12/1986 | Hudson et al. | 208/212 |
| 4,806,233 | 2/1989 | James, Jr. et al. | 208/262.1 |
| 5,024,750 | 6/1991 | Sughrue, II et al. | 208/57 |
| 5,720,872 | 2/1998 | Gupta | 208/57 |
| 5,853,682 | 12/1998 | Busson et al. | 423/237 |
| 5,925,235 | 7/1999 | Habib | 208/111.35 |

*Primary Examiner*—Walter D. Griffin
*Assistant Examiner*—Nadine Preisch
*Attorney, Agent, or Firm*—Millen, White, Zelano & Branigan, P.C.

[57] ABSTRACT

Described in a process for hydrotreating (HDT) a petroleum feedstock (1) that contains sulfur and nitrogen are the catalytic cracking of the ammonia, produced by the hydrotreating process, in a catalytic cracking furnace (F), the cooling (E2) and separating of the cracking effluent to produce an $H_2S$ containing gas phase, the extraction of the hydrogen sulfide from said gas phase and from the hydrotreating purge gas in an amine washing unit (20), and the separation (SM) of the hydrogen from the resultant effluent. The recovered hydrogen is recycled to hydrotreating unit (HDT) via a pipe (17).

15 Claims, 1 Drawing Sheet

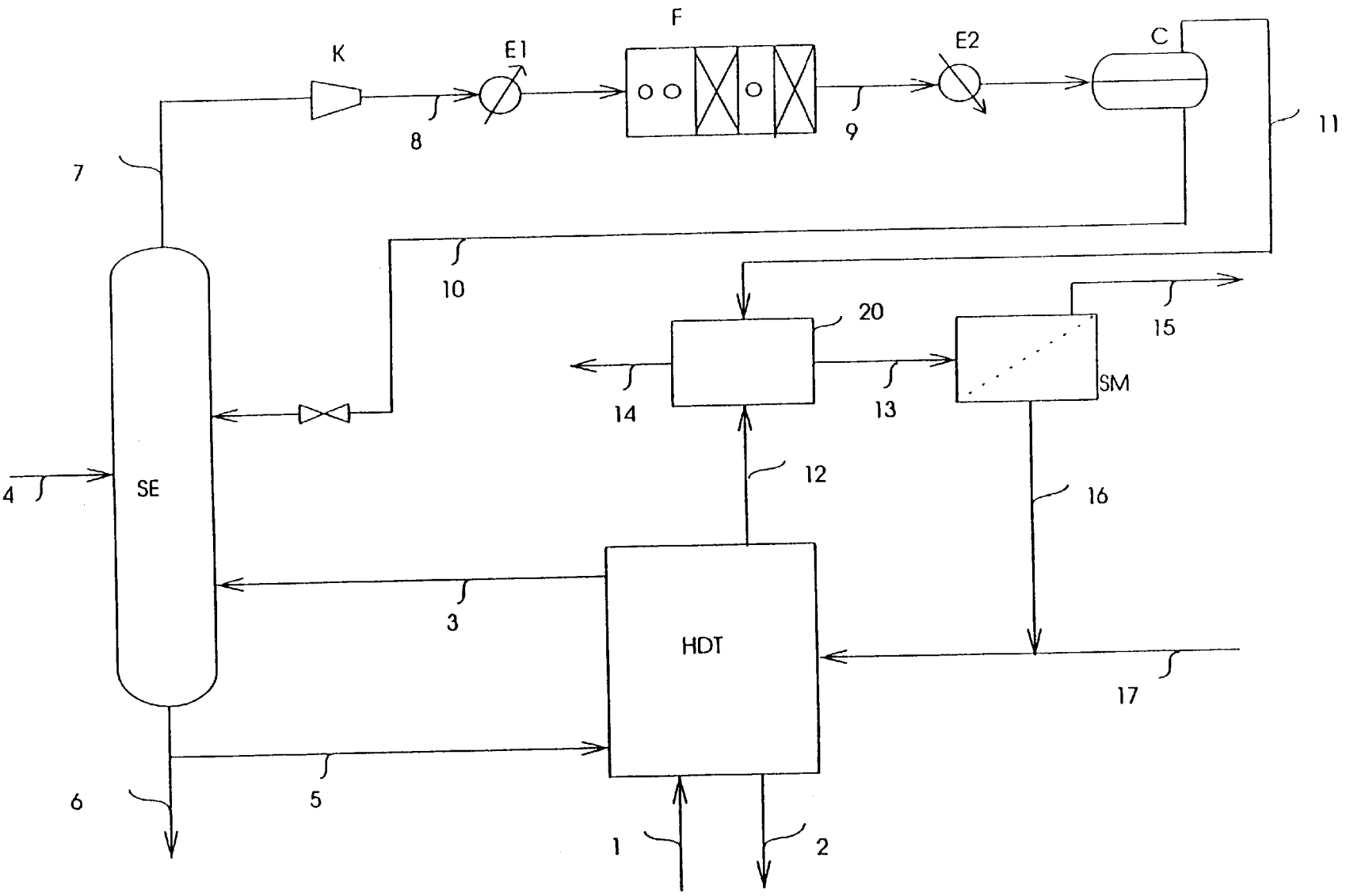
11
C
E2
9
F
E1
8
K
7
4
SE
6
5
3
10
20
12
14
13
SM
15
16
17
HDT
2
1

PROCESS AND UNIT FOR HYDROTREATING A PETROLEUM FEEDSTOCK THAT COMPRISES THE CRACKING OF AMMONIA AND THE RECYCLING OF HYDROGEN IN THE UNIT

The invention relates to a process and a device for catalytic cracking of ammonia that is contained in a gaseous fluid or liquid that comprises hydrogen sulfide, as well as the separation of the hydrogen that is produced by this ammonia cracking and the use of this hydrogen in a process for hydrotreating a hydrocarbon feedstock that contains sulfur and nitrogen.

The prior art is illustrated by the following patents: U.S. Pat. No. 3,627,470, U.S. Pat. No. 4,272,357, U.S. Pat. No. 3,365,374 and U.S. Pat. No. 4,806,233.

The pressurized-hydrogen treatments of liquid petroleum fractions (hydrotreatments) are processes that are well known and are widely used to improve the properties of these fractions. These treatments make it possible in particular to convert the organic compounds that contain heteroatoms (sulfur, nitrogen) into hydrocarbons and into mineral compounds (hydrogen sulfide, ammonia), and the latter can then be easily separated by simple operations such as stripping (distillation) and washing with water. Increased concern for protection of the environment leads to reducing the contents of sulfur and nitrogen in the petroleum products and thus to increasing the amount of hydrogen that is required for the operation of the hydrotreatment units.

Since the availability of refinery hydrogen is limited, refiners are led to minimize hydrogen losses at these hydrotreatment units. By design, however, these units always produce a high-pressure purging gas that is under a pressure that is generally between 20 and 100 bar (1 bar=0.1 MPa) and is relatively rich in hydrogen since the hydrogen content of this type of gas is generally greater than 50%. In modern hydrotreatment units, the approach is therefore to install a unit for recovering the residual hydrogen that is present in this high-pressure purging gas.

Various techniques can be used a priori for separating and recovering this hydrogen, such as cryogenic distillation, adsorption, or gaseous membrane permeation. The latter, however, is preferably used to treat the high-pressure purging gases of the hydrotreatment units. Such a use is well known today to one skilled in the art. It is possible, for example, to find a description of it in "Hydrogen Membrane Applications and Design" by G. L. Poffenbarger, AIChE Spring Natl. Meet. (Houston), Apr. 2–6, 1989, Preprint No. 61 b, incorporated as a reference.

During hydrotreatment operations, the nitrogen that is contained in the organic molecules is transformed into ammonia ($NH_3$). This ammonia is eliminated by washing with water which, owing to the presence of hydrogen sulfide ($H_2S$), provides an aqueous solution of ammonium sulfide. Up until now, the aqueous solution, after having been concentrated in $H_2S$ and $NH_3$ by stripping (distillation), was incinerated. This is no longer allowed for environmental reasons (pollution by $SO_2$ and nitrogen oxides).

Refiners are therefore led to send this product into the heating stage of a Claus unit. The combustion of ammonia at the heating stage of a Claus unit is, however, difficult to accomplish. It sometimes requires more or less significant modifications to the equipment of the Claus unit. This combustion, when it is not carried out correctly, can also cause numerous operating problems (clogging, corrosion of the Claus unit). Finally, it causes dilution of the gases of the Claus unit, which is detrimental to the performance levels of this unit.

In a French patent application from the applicant FR 96 02909, which is incorporated as a reference, there is described a process and a device for cracking the ammonia that is present in a gas that contains hydrogen sulfide.

An object of the invention is to make possible the recovery, or at least the partial recovery, at a hydrotreatment unit, of the hydrogen that is present in ammonia form, particularly in the sour water from refineries.

More specifically, the invention relates to a process for catalytic cracking of the ammonia that is present in a fluid that contains hydrogen sulfide, in which the fluid is introduced into a reaction zone that comprises a suitable catalyst, characterized in that the temperature of said reaction zone is 1000 to 1400° C. and in that the cracking effluent obtained at the output of said reaction zone is sent to a unit for recovering hydrogen that treats one (of the) high-pressure purging gas(es) of the hydrotreatment unit(s), after having been optionally cooled and/or partially condensed and/or compressed and/or treated by an amine washing unit.

This cracking process can be used in a hydrotreatment process.

BRIEF DESCRIPTION OF THE DRAWING

The drawing is a schematic flowsheet of an embodiment of the invention.

To go into further detail, the invention relates to a process for hydrotreating a hydrocarbon feedstock that contains sulfur and nitrogen, in which the feedstock is hydrotreated in the presence of a catalyst in a hydrotreating zone (HDT); a hydrotreated hydrocarbon product, a high-pressure purging gas (12) that comprises hydrogen, hydrogen sulfide, and light hydrocarbons ($C_{5-}$), and a first effluent that contains water and ammonium sulfide are recovered; the first effluent is purified in a stripping zone to recover the hydrogen sulfide and the ammonia; the first effluent is introduced into a cracking zone that comprises a catalyst, heated between 1000 and 1400° C.; a cracking effluent (9, 11) that contains hydrogen sulfide, hydrogen, and the nitrogen that result from cracking ammonia are recovered, whereby the process is characterized in that said cracking effluent is cooled to a suitable temperature, and a gaseous phase (11) that contains nitrogen, hydrogen and hydrogen sulfide is recovered; said gaseous phase is introduced into a unit (20) for extracting the hydrogen sulfide; the gaseous phase, from which almost all of the hydrogen sulfide has been removed, is thus sent to a hydrogen recovery unit (SM), and at least part-of the hydrogen that was recovered in hydrotreatment zone (HDT) is recycled.

According to a characteristic of the invention, high-pressure purging gas (12), which comes from the hydrotreatment zone, can be introduced with said gaseous phase into unit (20) for extracting the hydrogen sulfide, and a hydrogen sulfide-rich gas and the gaseous phase from which almost all of the hydrogen sulfide has been removed are recovered.

According to another characteristic, it is possible to cool the cracking effluent to a temperature of 30 to 100° C. in a heat exchanger E2 during a period of time that is at least equal to 1 second and preferably between 1 and 5 seconds.

According to a first variant of the process, it is possible to compress the first effluent to a pressure of 2 to 10 MPa which is compatible with the unit for extracting the hydrogen sulfide, before it is introduced into the cracking zone.

According to a second variant of the process, instead of compressing the first hydrotreatment effluent, it is possible to compress the cracking effluent that is cooled in exchanger E2 to a pressure of 2 to 10 MPa, which is compatible with the unit for extracting hydrogen sulfide.

According to a third variant, it is possible to compress simultaneously the first hydrotreatment effluent in front of the cracking zone, on the one hand, and, on the other, the cracking effluent that is cooled in exchanger E2 before extracting from it the hydrogen sulfide.

According to another characteristic of the process, it is possible to separate by decanting at least some of the water that is contained in the cracking effluent, and the gaseous phase that is introduced into said unit for extracting hydrogen sulfide and an aqueous liquid phase are recovered.

This aqueous liquid phase can be advantageously recycled in the stripping zone into which is introduced the effluent from the hydrotreatment zone that contains hydrogen sulfide and ammonia that is produced by the hydrotreatment unit, in the form of an aqueous solution of ammonium sulfide. This solution is stripped, and it is possible to recover, on the one hand, water that is purified at the bottom of the stripping zone and on the other hand from at the top of the stripping zone, a gaseous effluent that contains water vapor, hydrogen sulfide, and ammonia, said effluent being sent to the catalytic cracking zone.

The invention relates to a unit for hydrotreating a hydrocarbon feedstock that contains sulfur and nitrogen that comprises a hydrotreatment reactor (HDT) which comprises a supply (1) of the feedstock, a supply (17) of hydrogen, a drain (2) for the hydrotreated product, a drain (12) for purging gas, a drain (3) for an effluent that contains water and ammonium sulfide, a unit (20) for extracting hydrogen sulfide that is contained in the purging gas that is connected to the HDT reactor, whereby said extraction unit contains a line (14) for recovering a hydrogen sulfide-rich product and a line (13) for recovering a product that is low in hydrogen sulfide and rich in hydrogen, at least one hydrogen separator (SM) that is connected to line (13) for recovering the product that is low in hydrogen sulfide and rich in hydrogen and at least one means (16) for recycling the recovered hydrogen that is connected to the hydrogen separator and to the hydrotreatment reactor, whereby the hydrotreatment unit is characterized in that it comprises an effluent stripping means (SE) which is connected to drain (3), at least one catalytic cracking reactor for the stripped effluent that is suitable for operating between 1000 and 1400° C. that is connected to stripping means (SE), at least one cooling means ($E_2$) for the cracked effluent that contains hydrogen, at least one compressor (K) upstream from the cracking reactor or downstream from cooling means ($E_2$), and an output line (11) for a gaseous phase that is connected to unit (20) for extracting the hydrogen sulfide.

The invention will be better understood based on the FIGURE, which depicts a preferred embodiment of the invention and which illustrates the combination of a hydrotreatment unit and a device for catalytic cracking of the ammonia and the recycling of the hydrogen that results from it.

Consider hydrotreatment unit HDT that treats, in the presence of a catalyst, a liquid hydrocarbon feedstock that contains a certain ratio of sulfur and nitrogen, fed via a line 1. This unit produces via line 2 a hydrotreated hydrocarbon fraction, whose contents of sulfur and nitrogen are low.

The ammonia that is produced by the HDT unit is recovered by water washing of the effluent from the hydrotreatment reactor, in the form of an aqueous solution of ammonium sulfide that is sent via a line 3 to a waste water stripper SE. This stripper can optionally also be fed, via a line 4, with other similar waste water that comes from other units, which are not shown in the FIGURE. At the bottom, stripper SE produces purified water, which is essentially free of ammonium sulfide and which can be sent to hydrotreatment unit HDT to carry out the washing with water of the effluent from the reactor, via a line 5, and optionally to other units via a line 6.

At the top of stripper SE, a gaseous effluent that essentially consists of water vapor and approximately equal quantities of hydrogen sulfide and ammonia is recovered via a line 7, under a pressure that is generally between 0.1 and 0.5 MPa abs., and at a temperature that is generally between 50 and 150° C. The water content of the gaseous effluent is generally between 10 and 80%.

The effluent can be compressed in a compressor K to a pressure that is sufficient to allow it, after passing into an exchanger E1, an ammonia cracking reactor F, an exchanger E2, and a separator flask C, to be admitted to high-pressure amine washing unit 20, treating the high-pressure purging gas from hydrotreatment unit HDT. It is well understood that this compression stage K, which is located here preferably in front of reactor F, can also be placed behind reactor F, at the output of exchanger E2. The latter arrangement, however, offers the drawback of requiring the compression of a larger volume of gas, whereby 1 mol of ammonia is separated in reactor F into 0.5 mol of nitrogen and 1.5 mol of hydrogen. It is also possible to carry out the compression of the gaseous effluent up to the pressure that is required for it to be admitted into the high-pressure amine washing unit in two stages that are located respectively in front of and behind reactor F, as indicated above.

The compressed effluent is then sent via a line 8 to reactor F, optionally being preheated in exchanger E1, before being admitted into reactor F itself. The preheating can be carried out by any conventional heating means, such as a furnace, but also by heat exchange with the high-temperature effluent leaving reactor F.

Reactor F is the seat of the reaction zone where the cracking of ammonia into nitrogen and hydrogen is carried out, of which an embodiment and the conditions of use are described in the patent application FR 96/02.909.

The reaction effluent that leaves reactor F via a line 9, at a high temperature that is generally greater than 1000° C., is cooled in exchanger E2 to a temperature that allows it to be admitted into the high-pressure amine washing unit; this temperature is generally between 30 and 100° C., and preferably between 40 and 60° C.

This reaction effluent essentially consists of the nitrogen and hydrogen that result from the decomposition of ammonia in reactor F, as well as the hydrogen sulfide and water vapor that are present at the input and that have not reacted in reactor F. This reaction effluent also can contain traces of ammonia that have not been decomposed in reactor F. Considering the high conversion rates that are produced in reactor F, the residual ammonia content in the reaction effluent usually does not exceed 1% by volume, and is preferably less than 0.2% by volume.

The cooling of the reaction effluent can be done with a dwell time in exchanger E2 that is long enough to make it possible for elementary sulfur, which is derived from the separation of a portion of the hydrogen sulfide in reactor F, to recombine fully with the hydrogen that is present in hydrogen sulfide. The absence of a catalyst makes it possible to avoid significant recombination of the nitrogen and hydrogen into ammonia in exchanger E2. The cooled effluent at the output of E2 is therefore essentially free of elementary sulfur. For this purpose, the dwell time of the reaction effluent in exchanger E2 is at least equal to 1 second, and preferably between 1 and 5 seconds.

It is clear that faster cooling of the reaction effluent would be possible, but this would then require that this cooling be done in 2 stages, not shown in the diagram of the FIGURE. In the first stage, the reaction effluent would be cooled to a temperature that is slightly greater than the melting point of the sulfur, or a temperature of between 120 and 130° C. The elementary sulfur that is present in the effluent after this first stage could be recovered in the form of liquid sulfur by decanting into a separator flask. The cooling of the reaction effluent from which the elementary sulfur that it contained is removed can then be continued to the temperature that is required in a second stage.

The cooling of the reaction effluent can, depending on the final temperature that is reached at the output of E2 and the water content of said effluent, cause partial condensation of the water that is present in this effluent. If such condensation occurs, the aqueous phase that is thus formed can be separated by decanting into separator flask C.

At the bottom of flask C, a liquid aqueous phase that can contain the entire residual ammonia that is present in the reaction effluent, as well as the hydrogen sulfide that is dissolved in approximately equivalent proportions (in moles) in that of ammonia, are recovered. This aqueous phase can be sent to stripper SE via line 10. This system makes it possible to recycle the ammonia that has not reacted in furnace F and therefore to achieve total destruction of the ammonia that is present in the sour water that feeds stripper SE.

At the top of flask C, a gaseous phase that consists only of nitrogen, hydrogen, and for the most part hydrogen sulfide that is present in the reaction effluent is recovered in molar ratios that are approximately equal to 2 $H_2S$/1 $N_2$/3 $H_2$, as well as a small quantity of water vapor, generally less than 5% by volume, and preferably less than 1% by volume, corresponding to the vapor tension of water at the temperature of separator flask C.

This gaseous phase can then be sent via line 11 to a high-pressure amine washing unit 20, which treats the high-pressure purging gas that hydrotreatment unit HDT produces via a line 12. This purging gas essentially consists of hydrogen, hydrogen sulfide, and hydrocarbons that have mainly 1 to 5 carbon atoms, in variable proportions. It can also contain low contents, generally less than 5% by volume, of other compounds such as nitrogen and water vapor.

In amine unit 20, the purging gas and the gaseous phase are mixed and washed with an amine solution to extract the hydrogen sulfide from the gases. The washing with amines is generally carried out at the pressure of the purging gas, with this pressure generally being between 2 to 10 MPa, preferably between 3 and 7 MPa, and at a temperature that is generally between 30 and 100° C., preferably between 40 and 60° C.

The amine unit then produces, under a pressure and at a temperature that are approximately equal to those of the washing, a washed gas that is essentially free of hydrogen sulfide and that contains a large portion of other compounds of treated gases. The washed gas generally contains 20 to 95% by volume of hydrogen, preferably 50 to 90% by volume, with variable proportions of nitrogen, hydrocarbons of 1 to 5 carbon atoms and traces of water vapor (corresponding approximately to the vapor tension of water at the temperature of said washing).

The amine unit also produces, under a pressure that is generally less than that of the washing, preferably between 0.2 and 0.5 MPa abs., a hydrogen sulfide-rich gas that preferably contains at least 50% by volume of hydrogen sulfide with variable proportions of hydrocarbons, which is generally sent, via line 14, to a Claus unit.

The washed gas can then be sent via a line 13 to a hydrogen recovery unit. This unit can be a process for cryogenic distillation, adsorption, or membrane separation. With the washed gas being available under a relatively high pressure, preferably membrane separation such as the unit SM, shown in the FIGURE, is used. The washed gas can optionally be slightly cooled or reheated before being allowed into the permeation unit itself so that it will be at the optimum temperature for separating hydrogen by gaseous permeation, whereby this temperature is generally between 30 and 150° C., and preferably between 50 and 100° C.

The unit SM then makes it possible to produce, on the one hand, a hydrogen-poor gas (retentate) that generally contains less than 50% by volume of hydrogen, and preferably 5 to 30% by volume, with a large portion of the other compounds that are present in said washed gas, under a pressure that is close to that of the washed gas; on the other hand, a hydrogen-rich gas (permeate) that generally contains more than 90% by volume, and preferably more than 95% by volume, of hydrogen with variable proportions of other compounds that are present in the washed gas, under a pressure that is less than that of the washed gas, generally less than 2 MPa abs. and preferably between 0.5 and 1 MPa abs.

The retentate can then, for example, be sent via a line 15 to the combustible gas network of the refinery. The permeate, which is recovered via a line 16, can be mixed with the make-up hydrogen that feeds hydrotreatment unit HDT via a line 17.

One of the advantages of the process of the invention is to make it possible to ensure total destruction of the ammonia that is present in the refinery waste water, without any release that would pollute the atmosphere.

Another advantage of the process of the invention lies in the fact that the hydrogen sulfide that is present in the form of ammonium sulfide in the refinery waste water can thus be sent to the Claus unit in a concentrated form, in particular free of ammonia but also free of products (nitrogen and hydrogen) that are formed by the separation of this ammonia. This makes it possible to avoid problems that are associated with the combustion of the ammonia in the Claus units and in particular to reduce the dilution of the Claus gas.

Another advantage of the process lies in the possibility that it offers to recycle a large portion of the hydrogen that is present in the form of ammonia in the refinery waste water.

Finally, a last advantage of the process lies in its simplicity and in particular in the fact that it requires only the additional installation of a small number of pieces of equipment, compared to those that normally exist in a refinery that is equipped with hydrotreatment units. Actually, the units for high-pressure purging gas amine washing, recovery of hydrogen by membrane on the high-pressure purging gas SM, and stripping of waste water SE are normally present around modern hydrotreatment units. The process of the invention can generally be installed without significant modification of these existing units. It therefore requires only specific installation of compressor K, furnace F, exchangers E1 and E2, and separator flask C.

The following comparative example illustrates the invention.

Consider a hydrotreatment unit that treats a liquid hydrocarbon feedstock at a flow rate of 162.4 tons/h. This feedstock contains 2.12% by weight of sulfur and 0.057% by weight of nitrogen. This unit makes it possible to convert 98% of the sulfur that comes into the unit into $H_2S$ and 14% of the nitrogen into $NH_3$ in the presence of a conventional catalyst.

Via line 3, this unit produces waste water at a flow rate of 8173 kg/h and containing 0.6% by weight of ammonium sulfide. This water is treated in a stripper SE, which is operated under a pressure of 0.2 MPa abs. This stripper is also fed, via line 4, with a flow of 132550 kg/h of water that contains 2% by weight of ammonium sulfide and that comes from another refining unit. At the top, at a temperature of 80° C., the stripper produces a gas that contains 20% mol of water vapor, 40% mol of ammonia, and 40% mol of hydrogen sulfide, at a flow rate of 2965 $Nm^3/h$. At the bottom, purified water is produced at a temperature of 119° C. and at a flow rate of 137548 kg/h.

When the process of the invention is not introduced, the gas that is obtained at the top of the stripper should be incinerated or sent to a Claus unit when possible.

The hydrotreatment unit is also fed, via line 17, with a hydrogen-rich make-up gas. A large portion of this hydrogen is chemically consumed by the hydrotreatment reactions. Another portion is-in the high-pressure purging gas-that is produced via line 12, under a pressure of 4.6 MPa abs. This gas is desulfurated by washing with amines and then admitted via line 13 into a unit for recovering hydrogen by polyaramide membrane (Medal). It is thus possible to recover a large portion of the hydrogen that is present in the high-pressure purging gas and to recycle it via line 16 to the hydrotreatment unit.

Table 1 shows the balance of hydrogen of the hydrotreatment unit, as it usually occurs when the process of the invention is not introduced.

TABLE 1

Hydrogen Balance of the Hydrotreatment Unit in the Absence of the Process of the Invention

| | Make-up (17) | HP Purge (12) | Washed Purging (13) | Retentate (15) | Permeate (16) |
|---|---|---|---|---|---|
| Composition (% by vol) | | | | | |
| $H_2$ | 91.93 | 79.48 | 81.10 | 47.26 | 98.77 |
| $C_1$+ | 6.65 | 15.35 | 15.66 | 43.99 | 0.87 |
| $N_2$ | 1.36 | 3.18 | 3.24 | 8.75 | 0.36 |
| $H_2S$ | — | 1.99 | — | — | |
| $H_2O$ | — | — | — | — | |
| $NH_3$ | — | — | — | — | |
| P (bar abs) | 20 | 46 | 45 | 45 | 20 |
| T (° C.) | 90 | 50 | 50 | 90 | 90 |
| Flow rate ($Nm^3/h$) | 23536 | 8166 | 8003 | 2746 | 5257 |

This table shows that 80% of the hydrogen that is present in the high-pressure purging gas is recovered with the membrane unit. The quantity of hydrogen that is thus recovered represents 19.35% of the hydrogen that feeds the hydrotreatment unit (make-up+permeate). The hydrogen that is lost in the retentate represents only 4.84% of this supply of hydrogen.

On this same unit, equipment is now installed (compressors K and K1 (not shown), furnace F, exchangers E1 and E2, and separator flask C), that make it possible to implement the process of the invention.

Stripper SE is then fed not only with 8173 kg/h of waste water at 0.6% by weight of ammonium sulfide that comes from the HDT unit and with 132550 kg/h of water that contains 2% by weight of ammonium sulfide, but also, via line 10, with the condensed water in separator flask C. The flow rate of this condensed water is 473 kg/h, and it contains 0.85% by weight of ammonium sulfide. Stripper SE then produces at the top, under a pressure of 0.2 MPa abs. and at a temperature of 80° C., a gas that contains 40% by mol of hydrogen sulfide, 40% by mol of ammonia, and 20% by mol of water vapor, with a flow rate of 2968 $Nm^3/h$. At the bottom, this stripper produces purified water at a temperature of 119° C., with a flow rate of 138016 kg/h.

The gas that is thus obtained at the top of stripper SE is compressed in compressor K to a pressure of 0.7 MPa abs. and then reheated in exchanger E1 to a temperature of 1000° C. This hot gas then feeds a furnace F, which is built according to the method that is described in the applicant's application FR 96/02.909. The hot gas that leaves furnace F is cooled in exchanger E2 to a temperature of 50° C. The dwell time in exchanger E2 is set at 2 seconds. This cooling causes the condensation of a large portion of the water vapor that is present in the output gas of the furnace. This condensed water is recovered at separator flask C and is sent via line 10 to stripper SE. A flow rate of 3566 $Nm^3/h$ of a gas under a pressure of 0.6 MPa absolute, whose composition is provided in Table 2 below (cracked gas), is also recovered at separator flask C, via line 11. The degree of decomposition of the ammonia that is observed at the output of E2 is 99.85%. No noteworthy hydrogen sulfide decomposition can be observed after cooling in E2.

The cracked gas that is thus recovered via line 11 is compressed to a pressure of 4.6 Mpa abs. in a second compressor K1, not shown in the FIGURE, and then mixed with the high-pressure purging gas that leaves the HDT unit via line 12. This gas mixture is washed in amine washing unit 20, which produces, via line 13, a washed gas that feeds membrane separator SM under a pressure of 4.5 MPa. As above, the permeate of the SM unit is recycled to the hydrotreatment unit. Table 2 shows the hydrogen balance of the hydrotreatment unit when the process of the invention is introduced.

The preceding examples can be repeated with similar success by substituting the generically or specifically described reactants and/or operating conditions of this invention for those used in the preceding examples.

The entire disclosure of all applications, patents and publications, cited above, and of corresponding French application No. 97/10.679, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

TABLE 2

Hydrogen Balance of the Hydrotreatment Unit with the Process of the Invention

| | Make-up (17) | HP Purge (12) | Cracked Gas (11) | Washed Gas (13) | Retentate (15) | Permeate (16) |
|---|---|---|---|---|---|---|
| Composition (% by vol) | | | | | | |
| $H_2$ | 91.93 | 79.48 | 49.88 | 79.71 | 45.39 | 98.29 |
| $C_1$+ | 6.65 | 15.35 | — | 12.08 | 33.06 | 0.71 |
| $N_2$ | 1.36 | 3.18 | 16.60 | 8.21 | 21.54 | 0.99 |
| $H_2S$ | — | 1.99 | 33.26 | — | — | |
| $H_2O$ | — | — | 0.26 | — | — | |
| $NH_3$ | — | — | — | — | — | |
| P (bar abs) | 20 | 46 | 6 | 45 | 45 | 20 |
| T (° C.) | 90 | 50 | 50 | 50 | 90 | 90 |
| Flow rate ($Nm_3/h$) | 21989 | 8166 | 3566 | 10374 | 3644 | 6730 |

Table 2 shows that the quantity of hydrogen that is recovered by membrane unit SM this time represents 24.65% of the hydrogen supply (make-up+permeate) of the hydrotreatment unit, still with a recovery rate of 80% at the membrane unit itself. The recovery of the hydrogen that comes from the cracking of the ammonia makes it possible, particularly compared to the preceding case, to reduce the consumption of make-up hydrogen by 6.6%.

What is claimed is:

1. A process for hydrotreating a hydrocarbon feedstock that contains sulfur and nitrogen, in which the feedstock is hydrotreated in the presence of a catalyst in a hydrotreatment zone (HDT); a hydrotreated hydrocarbon product, a high-pressure purging gas (12) that contains hydrogen, hydrogen sulfide, and light hydrocarbons ($C_5$−), and a first liquid aqueous effluent that contains water and ammonium sulfide are recovered; the first effluent is purified in a stripping zone (SE) to recover a gaseous effluent comprising hydrogen sulfide, $H_2O$ and ammonia; the gaseous effluent is introduced into a cracking zone that comprises a catalyst, heated between 1000 and 1400° C.; a cracking effluent (9, 11), which contains hydrogen sulfide, $H_2O$, hydrogen and nitrogen that results from the cracking of the ammonia are recovered; whereby the process is characterized in that said cracking effluent is cooled to recover a gaseous phase (11) that contains nitrogen, hydrogen, and hydrogen sulfide; said gaseous phase is introduced into a unit (20) for extracting hydrogen sulfide; the gaseous phase from which hydrogen sulfide has thus been removed is passed through a hydrogen recovery unit (SK, and at least part of the hydrogen that is recovered is recycled to hydrotreatment zone (HDT).

2. A process according to claim 1, wherein high-pressure purging gas (12) from the hydrotreatment zone is introduced into unit (20) for extraction of the hydrogen sulfide, and a hydrogen sulfide-rich gas and the gaseous phase from which hydrogen sulfide has been removed are recovered.

3. A process according to claim 1, wherein the cracking effluent is cooled to a temperature of 30 to 100° C. in a heat exchanger E2 during a period of time that is at least equal to 1 second.

4. A process according to claim 1, wherein the gaseous effluent is compressed to a pressure of 2 to 10 MPa which is compatible with the extraction unit of the hydrogen sulfide, before it is introduced into the cracking zone.

5. A process according to claim 1, wherein the cracking effluent that is cooled in exchanger E2 is compressed to a pressure of 2 to 10 MPa which is compatible with the extraction unit of the hydrogen sulfide.

6. A process according to claim 1, wherein the hydrogen sulfide extraction unit is a high-pressure unit for extraction with amines.

7. A process according to claim 1, wherein the hydrogen recovery unit is a membrane permeation unit.

8. A process according to claim 1, wherein said cracking effluent is cooled sufficiently to form an aqueous liquid phase and at least a portion of the water that is contained in the liquid phase is separated by decanting.

9. A process according to claim 8, wherein the resultant decanted aqueous liquid phase is recycled to said stripping zone (SE).

10. A process according to claim 3, wherein the period of time is between 1 and 5 seconds.

11. A process according to claim 6, wherein the hydrogen recovery unit is a membrane permeation unit.

12. A process according to claim 11, wherein at least a portion of the water that is contained in the cracking effluent is separated by decanting, and the gaseous phase that is introduced into said unit for extraction of hydrogen sulfide and an aqueous liquid phase are recovered.

13. A process for hydrotreating a hydrocarbon feedstock containing sulfur and nitrogen, comprising hydrotreating the feedstock in the presence of a catalyst in a hydrotreatment zone (HDT) to recover a hydrotreated hydrocarbon product, a high-pressure purging gas (12) containing hydrogen, hydrogen sulfide, and light hydrocarbons ($C_5$−), and a first aqueous liquid effluent containing water and ammonium sulfide; purifying the first effluent in a stripping zone (SE) with water to separate a liquid water phase and a gaseous effluent comprising $H_2O$, hydrogen sulfide and ammonia; introducing the gaseous effluent into an ammonia cracking zone comprising a catalyst, heated between 1000 and 1400° C. to produce a cracking effluent (9, 11) containing hydrogen sulfide, hydrogen, $H_2O$ and $N_2$ cooling said cracking effluent and separating a gaseous phase (11) containing nitrogen, hydrogen, and hydrogen sulfide; introducing said gaseous phase (11) into a unit (20) for extracting hydrogen sulfide; passing the resultant $H_2S$-depleted gaseous phase through a hydrogen recovery unit (SM), recycling at least part of the resultant recovered hydrogen to said hydrotreatment zone (HDT), and introducing said purging gas into a unit for extracting hydrogen sulfide.

14. A unit for hydrotreatment of a hydrocarbon feedstock that contains sulfur and nitrogen, whereby said unit contains a hydrotreatment reactor (HDT) that comprises a supply (1) for the feedstock, a supply (17) for hydrogen, a drain (2) for hydrotreated product, a conduit (12) for purging gas, a drain (3) for an effluent that contains water and ammonium sulfide, and a unit for extraction (20) of the hydrogen sulfide that is contained in the purging gas that is connected to the reactor (HDT), whereby said extraction unit contains a line (14) for recovering a product that is rich in hydrogen sulfide, and a line (13) for recovering a product that is low in hydrogen sulfide and rich in hydrogen, at least one hydrogen separator (SM) that is connected to line (13) for recovery of the product that is low in hydrogen sulfide and rich in hydrogen and at least one means (16) for recycling the recovered hydrogen that is connected to the hydrogen separator and to the hydrotreatment reactor, with the hydrotreatment unit being characterized in that it contains an effluent stripping means (SE) connected to drain (3), at least one catalytic cracking reactor for the stripped effluent suitable for operating between 1000 and 1400° C. and is connected to stripping means (SE), at least one cooling means ($E_2$) for the cracked effluent that contains hydrogen, at least one compressor (K) that is upstream from the cracking reactor or downstream from cooling means ($E_2$), and an output line (11) for a gaseous phase that is connected to unit (20) for extracting the hydrogen sulfide.

15. A unit according to claim 14, in which a phase separator is interposed between cooling means E2 and extraction unit (20), containing a line (10) for recycling a liquid phase in the stripping means and output line (11) for a gaseous phase that is connected to said hydrogen sulfide extraction unit (20).

* * * * *